US006443848B1

(12) United States Patent
Sisofo

(10) Patent No.: US 6,443,848 B1
(45) Date of Patent: Sep. 3, 2002

(54) LEVITATION ENTERTAINMENT DEVICE

(76) Inventor: S. Attillio Sisofo, 439 Wilford Ave., Longwood, FL (US) 32750

( * ) Notice: Subject to any disclaimer, the term of this patent is extended or adjusted under 35 U.S.C. 154(b) by 0 days.

(21) Appl. No.: 09/907,813

(22) Filed: Jul. 18, 2001

(51) Int. Cl.[7] ..... A63G 31/00
(52) U.S. Cl. ..... 472/68; 472/73
(58) Field of Search ..... 472/57, 65, 68, 472/71, 72, 73, 75, 81, 61

(56) References Cited

U.S. PATENT DOCUMENTS

| | | | | |
|---|---|---|---|---|
| 1,541,925 | A | | 6/1925 | Davidson |
| 1,613,254 | A | | 1/1927 | Thurston et al. |
| 1,855,648 | A | | 4/1932 | Prins |
| 2,055,498 | A | | 9/1936 | Jacobs |
| 2,614,363 | A | * | 10/1952 | Bowditch ..... 248/364 |
| 4,244,566 | A | * | 1/1981 | Molovinsky ..... 190/18 A |
| 5,147,129 | A | | 9/1992 | Ku |
| 5,297,352 | A | | 3/1994 | Poll |
| 5,354,238 | A | | 10/1994 | Gaughan |
| 5,445,388 | A | | 8/1995 | Mitchell |

* cited by examiner

*Primary Examiner*—Kien T. Nguyen
(74) *Attorney, Agent, or Firm*—Edward M. Livingston, Esq.

(57) ABSTRACT

A levitation-entertainment device has a micro fiber (1) with an object end attached to a select small levitation object (2, 6, 7) placed removably on a levitation base (5) and a base end attached detachably to a base structure (14) that is situated for manipulation of the micro fiber by a manipulation individual from a manipulation space (4) that is intermediate the object end and the base end of the micro fiber. The base structure can include an ear, another body part, an article of clothing or other item proximate the manipulation individual. Vision enhancement (8, 9, 10, 12) can be positioned on an outside of or in an inside of the levitation object.

22 Claims, 4 Drawing Sheets

FIG. 7
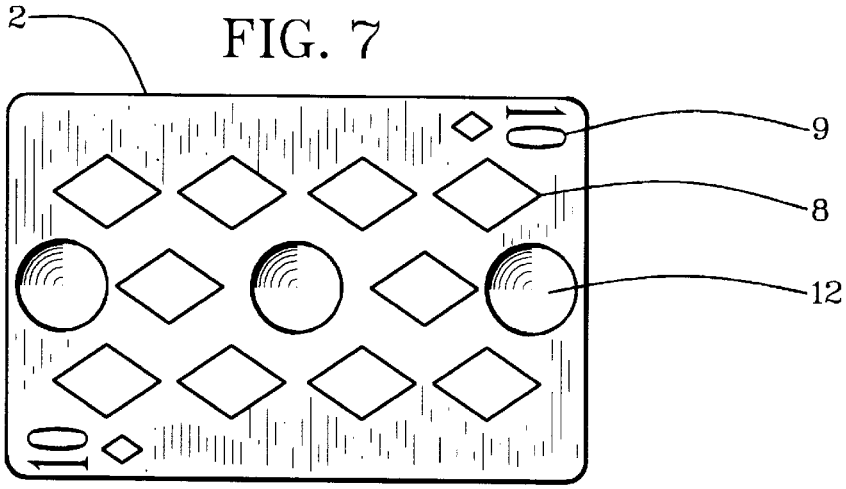
FIG, 8
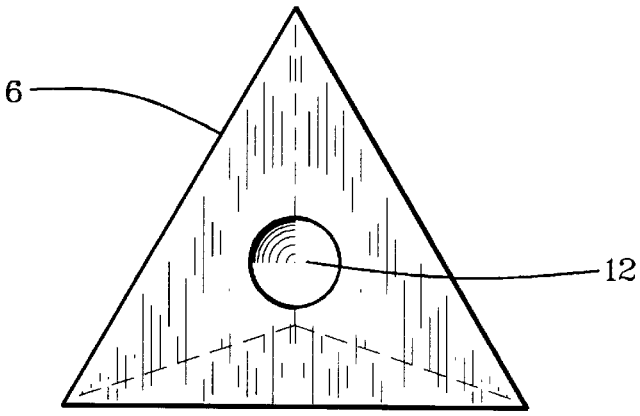
FIG. 10
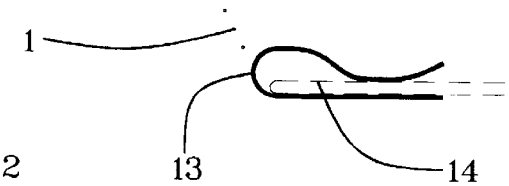
FIG. 9
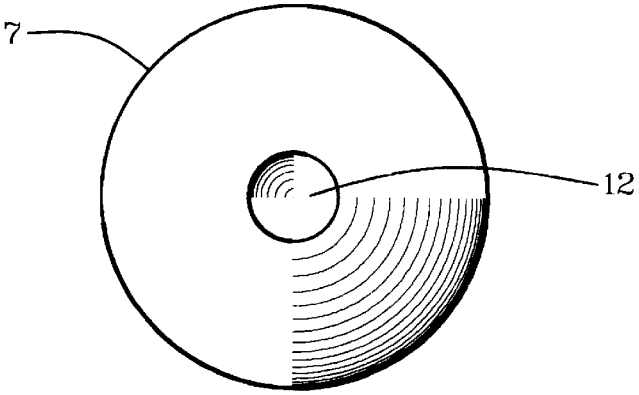

LEVITATION ENTERTAINMENT DEVICE

BACKGROUND OF THE INVENTION

This invention relates to entertainment devices that simulate levitation of small, light items including cards, pictures, other planar items and geometrical objects.

Known entertainment devices for simulating levitation are limited to articulation for supporting human bodies and other specific items. Also known are devices for creating select optical illusions of distortion, displacement and movement of small, card-sized objects. None are known, however to have micro-fiber support of objects having optionally select illumination in a manner taught by this invention.

Examples of most-closely related known but different devices are described in the following patent documents:

| U.S. Pat. No. | Inventor | Issue Date |
|---|---|---|
| 5,354,238 | Gaughan | 10/11/1994 |
| 1,541,925 | Davidson | 05/24/1923 |
| 1,668,263 | Blodgett | 05/01/1928 |
| 5,147,129 | Ku | 09/15/1992 |
| 1,855,648 | Prins | 04/26/1932 |
| 2,055,498 | Jacobs | 09/29/1936 |
| 1,613,254 | Thurston, et al. | 01/04/1927 |
| 5,297,352 | Poll | 03/29/1994 |
| 5,445,388 | Mitchell | 08/29/1995 |

SUMMARY OF THE INVENTION

Objects of patentable novelty and utility taught by this invention are to provide a levitation-entertainment device which:

creates an illusion of levitation of cards and other small items; is adaptable to simulation of levitation of a selection of small items; and can simulate a selection of levitation of the small items.

This invention accomplishes these and other objectives with a levitation-entertainment device having a micro fiber with an object end attached to a select small levitation object placed removably on a manipulation base and a base end attached detachably to a base structure that is situated for manipulation of the micro fiber by a manipulation individual from a manipulation position that is intermediate the object end and the base end of the micro fiber. The base structure can include an ear, another body part, an article of clothing or other item proximate the manipulation individual. The levitation object can include a playing card that can be lighted by an LED with power from a lithium battery on the playing card.

The above and other objects, features and advantages of the present invention should become even more readily apparent to those skilled in the art upon a reading of the following detailed description in conjunction with the drawings wherein there, is shown and described illustrative embodiments of the invention.

BRIEF DESCRIPTION OF DRAWINGS

This invention is described by appended claims in relation to description of a preferred embodiment with reference to the following drawings which are explained briefly as follows:

FIG. 7 is a top view of the playing card having a reflective surface for the vision enhancement as the levitation object;

FIG. 8 is a side view of the pyramid having the reflective surface for the vision enhancement as the levitation object;

FIG. 9 is a side view of the sphere having the reflective surface for the vision enhancement as the levitation object; and FIG. 10 is a top view of a clamp as a base attachment of a micro fiber to an ear, article of clothing or other structure proximate a levitation performer.

DESCRIPTION OF PREFERRED EMBODIMENT

Listed numerically below with reference to the drawings are terms used to describe features of this invention. These terms and numbers assigned to them designate the same features throughout this description.

| | |
|---|---|
| 1. Micro fiber | 9. Color-contrast numbers |
| 2. Playing card | 10. LED |
| 3. Adherence material | 11. Miniature battery |
| 4. Manipulation space | 12. Reflective surface |
| 5. Levitation base | 13. Clamp |
| 6. Pyramid | 14. Base structure |
| 7. Sphere | 15. Levitation prop |
| 8. Color-contrast marks | |

Figure 1:
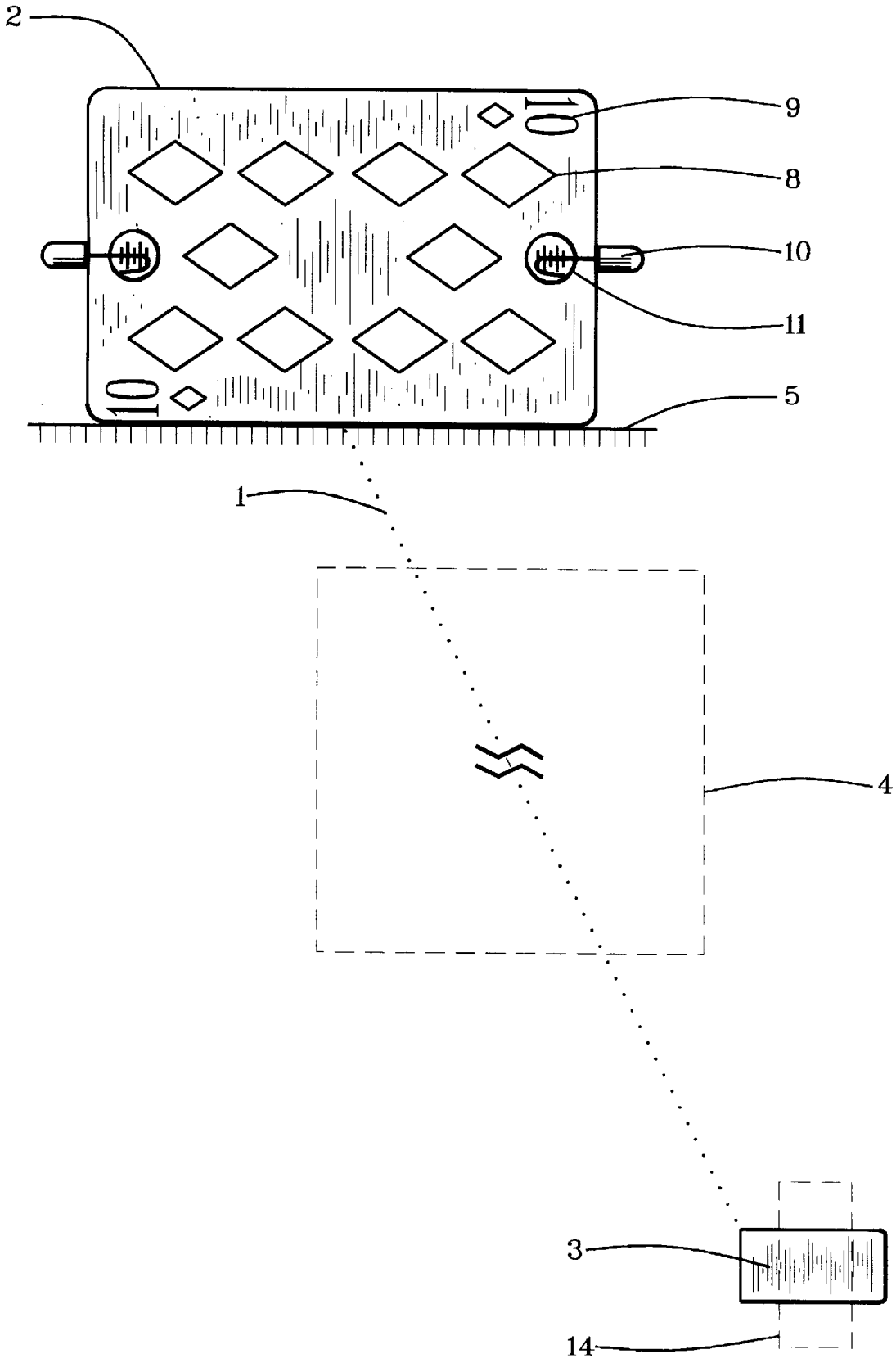
FIG. 1 is a plan view showing a playing card lighted by an LED as a levitation object.

Referring to FIG. 1, the levitation-entertainment device has a micro fiber 1 with an object end attached to a levitation object that includes a playing card 2 and a base attachment that includes an adherence material 3 on a base end. Intermediate the object end and the base end of the micro fiber 1 is a manipulation space 4 where a levitation performer, who is not shown, can manipulate the micro fiber 1 for simulation of levitation of the levitation object in levitation space that is proximate a levitation base 5 which can support the levitation object that is represented by the playing card 2 in this embodiment.

The micro fiber 1 has a sufficiently small diameter that it is not readily visible, particularly in dimly lighted conditions where levitation entertainment is likely to be practiced. Tensile strength of the micro fiber 1 can be three-hundred-thousand pounds per square inch ("psi") for manufacture from relatively expensive metallic materials and fifty-thousand psi for manufacture from relatively inexpensive plastic materials. Accordingly, the micro fiber can have a diameter as small as two-thousandths of an inch and as large as ten-thousandths of an inch.

Figure 2:
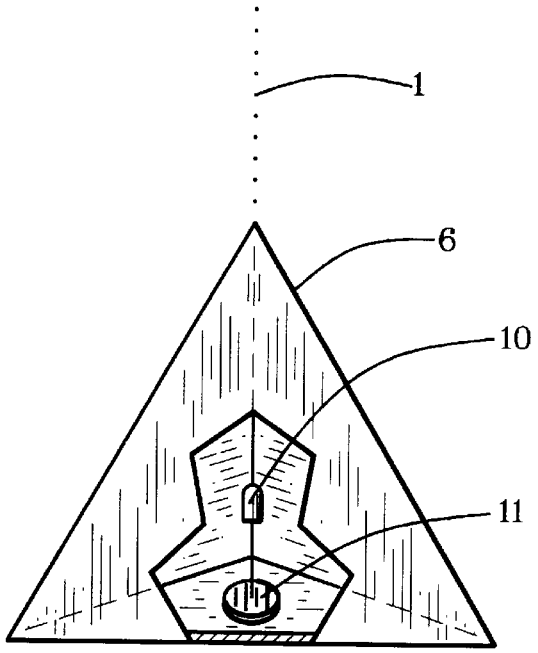
FIG. 2 is a partially cutaway side view of a hollow translucent pyramid lighted internally with the LED for vision enhancement as the levitation object.
Figure 3:
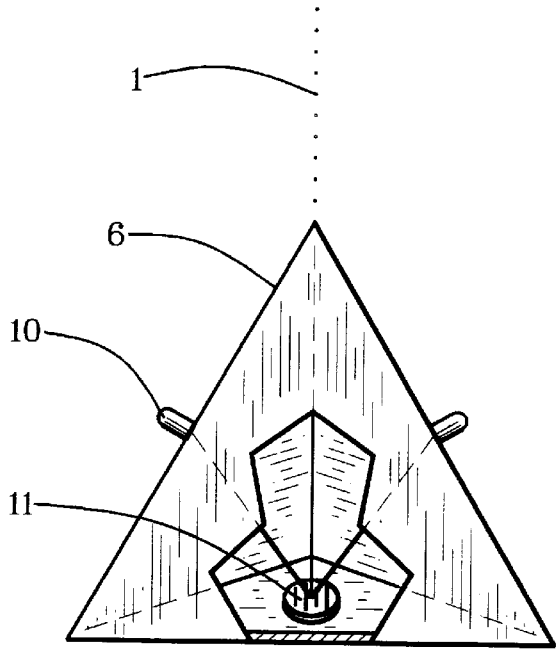
FIG. 3 is a partially cutaway side view of a hollow pyramid lighted externally with the LED for vision enhancement as the levitation object.
Figure 4:
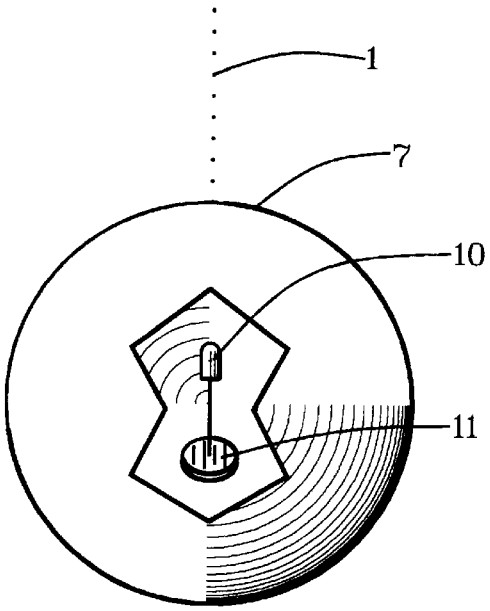
FIG. 4 is a partially cutaway side view of a hollow translucent sphere lighted internally with the LED for vision enhancement as the levitation object.
Figure 5:
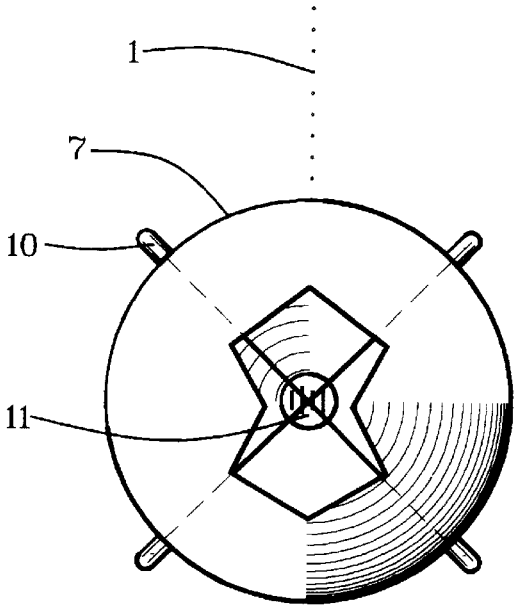
FIG. 5 is a partially cutaway side view of a hollow sphere lighted externally with the LED for vision enhancement as the levitation object.

Referring to FIGS. 1–9, selectively and optionally, the levitation objects can include the playing card 2 shown in FIGS. 1 and 7, polyhedrons that include pyramids 6 shown in FIGS. 2–3, 6 and 8, and arcuate objects that include the sphere 7 shown in FIGS. 4–5 and 9.

Also selectively and optionally, the levitation object has vision enhancement which can include color-contrast marks 8, color-contrast numbers 9, LEDs 10 powered by miniature batteries 11 and reflective surfaces 12.

Figure 6:
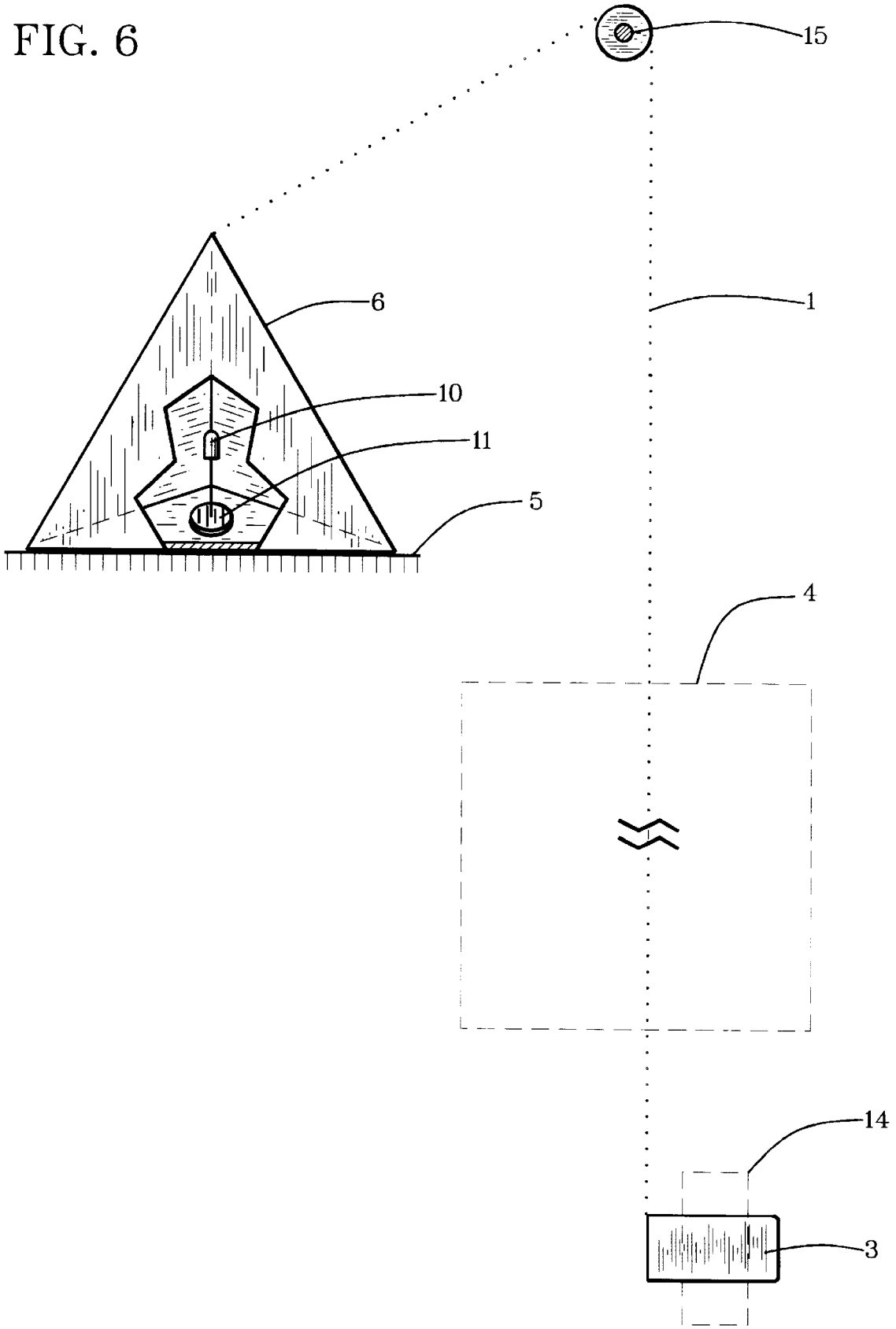
FIG. 6 is a plan view featuring a prop and showing the hollow pyramid lighted internally with the LED for vision enhancement as the levitation object.

The LEDs 10 can be on the outside of the levitation object as shown in FIGS. 1, 3 and 5 or inside of the levitation object, having predeterminedly transparent walls, as shown in FIGS. 2, 4 and 6.

Referring to FIGS. 3, 6 and 10, the base attachment can include a clamp 13 on the base end of the micro fiber 1. The clamp 13 and the adherence material can be articulated for attachment to base structure 14 which can include an ear, article of clothing and other proximate structure of choice by the levitation performer selectively.

Referring to FIG. 6, the levitation-entertainment device can include a levitation prop 15 intermediate the levitation base 5 and the base structure 14. The levitation prop 15 is situated in a direction from the levitation base 5 that is predeterminedly different from a direction from the levitation base 5 to the base structure 14 in order to provide selective directional manipulation of the particular levitation object. Accordingly, the micro fiber 1 is routed through the manipulation space 4 en route from the levitation prop 15 to the base structure 14.

A new and useful levitation-entertainment device having been described, all such foreseeable modifications, adaptations, substitutions of equivalents, mathematical possibilities of combinations of parts, pluralities of parts, applications and forms thereof as described by the following claims and not precluded by prior art are included in this invention.

What is claimed is:

1. A levitation-entertainment device comprising:

a micro fiber having an object end and a base end;

a levitation object attached to the object end of the micro fiber;

a base attachment on the base end of the micro fiber;

vision enhancement on a predetermined portion of the levitation object;

the levitation object being placable removably on a levitation base;

the base attachment being situated removably on an attachment base;

the micro fiber being articulated for situation in a manipulation space that is intermediate the levitation base and the attachment base;

the micro fiber and the levitation object being articulated for simulation of levitation of the levitation object in levitation space that is proximate the levitation base; and the micro fiber being manipulated by a levitation performer.

2. The levitation-entertainment device of claim 1 wherein:

the micro fiber has a diameter of less than ten-thousandths of an inch and preferably less than five thousandths of an inch.

3. The levitation-entertainment device of claim 1 wherein:

the diameter of the micro fiber is about three-thousandths of an inch.

4. The levitation-entertainment device of claim 1 wherein:

the micro fiber has a tensile strength in excess of fifty-thousand pounds per square inch.

5. The levitation-entertainment device of claim 1 wherein:

the micro fiber includes a plastic material.

6. The levitation-entertainment device of claim 1 wherein:

the micro fiber includes a metallic material.

7. The levitation-entertainment device of claim 1 wherein:

the tensile strength of-the micro fiber is in excess of two-hundred-thousand pounds per square inch.

8. The levitation-entertainment device of claim 1 wherein:

the levitation object includes a planar surface.

9. The levitation-entertainment device of claim 1 wherein:

the levitation object includes a playing card.

10. The levitation-entertainment device of claim 1 wherein:

the levitation object includes a plurality of planar surfaces.

11. The levitation-entertainment device of claim 1 wherein:

the levitation object includes a polyhedron having predeterminedly low mass and size.

12. The levitation-entertainment device of claim 1 wherein:

the levitation object includes a predeterminedly spherical object.

13. The levitation-entertainment device of claim 1 wherein:

the base attachment includes a clamp that is articulated to be attached to base structure that includes an ear, article of clothing and other proximate structure of choice by the levitation performer selectively.

14. The levitation-entertainment device of claim 1 wherein:

the base attachment includes an adhesion item that is articulated to be adhered to an ear, article of clothing and proximate structure of choice by the levitation performer selectively.

15. The levitation-entertainment device of claim 1 wherein:

the vision enhancement includes an LED that is powered by a battery on the levitation object.

16. The levitation-entertainment device of claim 1 wherein:

the vision enhancement includes an LED that is powered by a battery in the levitation object.

17. The levitation-entertainment device of claim 1 wherein:

the vision enhancement is on the levitation object.

18. The levitation-entertainment device of claim 1 wherein:

the vision enhancement is in the levitation object.

19. The levitation-entertainment device of claim 1 wherein:

the vision enhancement includes a predeterminedly reflective surface.

20. The levitation-entertainment device of claim 1 and further comprising:

a levitation prop intermediate the levitation base and the base structure.

21. The levitation-entertainment device of claim 20 wherein:

the levitation prop is situated in a direction from the levitation base that is predeterminedly different from a direction from the levitation base to the base structure.

22. The levitation-entertainment device of claim 21 wherein:

the micro fiber is routed through the manipulation space en route from the levitation prop to the base structure.

* * * * *